US008418506B2

(12) United States Patent
Barea

(10) Patent No.: US 8,418,506 B2
(45) Date of Patent: Apr. 16, 2013

(54) METHOD AND DEVICE FOR AUTOMATICALLY MEASURING THE YARN LENGTH FED TO A RECTILINEAR MACHINE

(75) Inventor: Tiziano Barea, Busto Arsizio (IT)

(73) Assignee: B.T.S.R. International S.p.A., Olgiate Olona (IT)

( * ) Notice: Subject to any disclaimer, the term of this patent is extended or adjusted under 35 U.S.C. 154(b) by 0 days.

(21) Appl. No.: 13/375,681

(22) PCT Filed: Jun. 9, 2010

(86) PCT No.: PCT/IB2010/001419

§ 371 (c)(1),
(2), (4) Date: Dec. 1, 2011

(87) PCT Pub. No.: WO2010/143064

PCT Pub. Date: Dec. 16, 2010

(65) Prior Publication Data

US 2012/0285205 A1 Nov. 15, 2012

(30) Foreign Application Priority Data

Jun. 12, 2009 (IT) ..... MI2009A1037
Jul. 17, 2009 (IT) ..... MI20090239 U

(51) Int. Cl.
*D04B 15/38* (2006.01)

(52) U.S. Cl.
USPC ..... 66/60 R; 66/126 R

(58) Field of Classification Search ..... 66/60 R, 66/64, 77, 126 R, 146; 700/140, 141
See application file for complete search history.

(56) References Cited

U.S. PATENT DOCUMENTS

| | | | | |
|---|---|---|---|---|
| 4,744,227 | A | 5/1988 | Whitener, Jr. et al. | |
| 4,752,044 | A * | 6/1988 | Memminger et al. | 66/132 R |
| 6,010,052 | A * | 1/2000 | Leins et al. | 66/146 |
| 6,321,576 | B1 | 11/2001 | Barea | |
| 7,289,869 | B2 * | 10/2007 | Morita | 700/141 |
| 7,421,860 | B2 * | 9/2008 | Dias et al. | 66/132 R |
| 8,090,467 | B2 * | 1/2012 | Minami et al. | 700/141 |
| 2005/0224619 | A1 | 10/2005 | Barea | |

FOREIGN PATENT DOCUMENTS

| | | | |
|---|---|---|---|
| DE | 19537325 | C1 | 11/1996 |
| EP | 0489307 | A1 | 6/1992 |
| EP | 0950742 | A2 | 10/1999 |

OTHER PUBLICATIONS

International Search Report dated Feb. 17, 2011 from PCT/IB2010/001419 to Barea filed Jun. 9, 2010 (WO 2010/143064 A2).

* cited by examiner

*Primary Examiner* — Danny Worrell
(74) *Attorney, Agent, or Firm* — Novak Druce Connelly Bove + Quigg LLP

(57) ABSTRACT

A method and device for automatically measuring the yarn length absorbed by a rectilinear machine adapted to produce an article and including a carriage movable to-and-fro over a needle bed between two ends of a working path, needles moving towards the carriage to cooperate with the yarn (F) and form an article, the yarn unwinding from a feeder with elements for measuring the yarn quantity fed at constant tension towards the needle bed. The feeder measures and constantly monitors the yarn feed velocity, this monitoring enables the fed and knitted yarn quantity to be obtained in real time and each measurement to be associated with the respective carriage travel stroke, this information enabling precise regulation of the knitting cams.

12 Claims, 2 Drawing Sheets

METHOD AND DEVICE FOR AUTOMATICALLY MEASURING THE YARN LENGTH FED TO A RECTILINEAR MACHINE

CROSS-REFERENCE TO RELATED APPLICATIONS

This application is a §371 National Stage Application of International Application No. PCT/IB2010/001419, filed on 9 Jun. 2010, claiming the priority of Italian Patent Application No. MI2009A001037 filed on 12 Jun. 2009 and Italian Patent Application No. MI2009U000239 filed on 17 Jul. 2009.

FIELD OF THE INVENTION

The present invention relates to a method for automatically evaluating the yarn length absorbed during the production of an article by a rectilinear machine in accordance with the introduction to the main claim. The present invention also relates to a device for implementing the method.

BACKGROUND OF THE INVENTION

A rectilinear machine is known to comprise a structure provided with at least one feeder for yarn withdrawn from a corresponding package. The yarn is carried above a machine needle bed by a carriage translating horizontally along said bed (while the needles move vertically, or perpendicular to the carriage movement direction).

During its movement, this carriage raises the needles from a rest position by knitting cams which define the needle raising and lowering "profile" (profiles predefined to enable a knitted fabric article to be produced of the required form and/or pattern). The needles hence withdraw the yarn associated with thread guides carried by the carriage, after which they are returned to their rest position in the needle bed such as to knit said yarn together with a yarn previously withdrawn and joined to other adjacent yarns in forming the article during production.

Hence by adjusting said cams (or knitting triangles), the length of each stitch can be defined, this determining the knitted yarn length.

In rectilinear machines said carriage undergoes reciprocating movements between two ends of a working path (on the rectilinear machine the carriage moving from right to left and vice versa). This movement also results in the movement of one or more thread guides, which carry the yarns used to form the stitch via said needles.

To ensure the knitting quality it is very important, in a machine of the stated type, for the yarn consumption (i.e. the yarn effectively knitted to produce the article by predefined needles) to be exactly equal during both carriage movements (from right to left and vice versa). It is therefore important to ensure that the yarn length absorbed (AYL) by the needles is constant during each complete stroke (from right to left and vice versa) of the carriage above the needle bed, this being achieved by suitably regulating said knitting cams (knitting triangles). If the AYL is not equal during the two phases of said stroke (outward towards one end and return towards the other end of the working path), the knitted yarn quantity would be different during one phase than during the other, with an evident article defect (barring).

To solve the aforesaid problem and to achieve equal AYL during the two phases of the carriage travel stroke, passive measurement devices for fed yarn are known (roller type) able to measure the effective yarn consumption in the two said phases during article production. However these devices merely measure the yarn quantity fed during each travel phase, but are unable to determine if the travel is away from or towards the yarn feeder (wherever this latter is positioned relative to the needle bed).

Constant tension yarn feed devices are also known able not only to maintain the yarn tension constant during its feed to the machine, but also to measure the yarn quantity fed to it. These devices can also determine the fed yarn quantity but not the carriage movement direction along the needle bed. Moreover all currently known devices involve lengthy adjustment times, this affecting the article time and production cost, and require to be synchronized during their operation with the various machine operating stages.

In addition, all currently known devices are devices used only during the adjustment stage, rather than the production stage; they hence provide for machine regulation within a configuration different from that normally used during the production stage.

EP 0 950 742 relates to a device for controlling the feed of yarn fed to a textile machine such as a knitting machine, hosiery machine or a bobbin winder. It comprises means for ascertaining the yarn tension and means for measuring its feed velocity to the textile machine. The ascertainment and measurement being effected by evaluation and control means which enable the tension and velocity values to be established with precision. A method implemented using the aforesaid device enables the evaluation and control means to control and regulate the operation of the textile machine and, for example, the stitch length in a knitting or hosiery machine.

SUMMARY OF THE INVENTION

An object of the present invention is to provide a method and device for correct and precise determination of the yarn length absorbed (AYL) by the textile machine which represent an improvement over currently known solutions and which enable a constant AYL value to be maintained during the two phases of the machine carriage travel stroke.

A further object of the present invention is to provide a method and device for correct and precise machine regulation, this method and device being able to be used identically during the production stage, the method and device being such as to enable the machine to be calibrated within the same configuration as that which it possesses in the production stage, and to enable continuous monitoring of the AYL value during the machine production stages.

A particular object of the invention is to provide a machine of the stated type, the implementation of which does not require any evaluation and/or synchronization with the operative steps of the textile machine or of the phases of the carriage travel stroke above the machine needle bed.

Another object is to provide a method of the stated type, the implementation of which does not include a lengthy preliminary step of machine adjustment.

A further object is to provide a method and device of the stated type, the implementation and/or execution of which enable the textile machine to be simplified in terms of accessories such as electric stops, mechanical recovery members, anti-pull devices or the like.

A further object is to provide a device which enables said constant AYL measurement and control to be achieved while feeding the yarn at constant tension.

A particular object of the invention is to provide a device of the stated type which enables the constancy of AYL to be measured and controlled while feeding the yarn at constant tension both in the case in which this tension is the same for both carriage travel strokes and in the case in which the tension is different to compensate the different friction between yarn and thread guide in the two directions, differences due particularly to the two different feed velocities, the friction being a function of the velocity.

A further particular object is to provide a device and method of the stated type which enable the yarn consumption and the particular phase of the carriage travel stroke (away from or towards the yarn feed device) above the needle bed to be easily determined.

Another object of the present invention is to provide a method and device according to the invention, the implementation and/or execution of which is totally independent of the machine model (different from constructor to constructor) and type (mechanical or electronic, for example).

Another object of the present invention is to achieve indirect measurement of the knitting density of the produced article by precisely measuring the AYL during each phase of the carriage travel stroke, obtained with yarn fed at constant tension. This enables said value to be also reproduced on other production machines for the same article, to hence achieve constant quality products obtained by a series of machines, hence ensuring easy reproducibility of the article even on different machines.

Another object is to highlight, by monitoring the tension and the AYL, any possible quality or irregularity problems during the production process, such as dirt accumulation on the thread guide carried by the carriage, mistaken yarn passage between feed device and machine needles, yarn breakage, loss of machine calibration, etc.

These and other objects which will be apparent to the expert of the art are attained by a method and device in accordance with the accompanying claims.

DETAILED DESCRIPTION OF THE PREFERRED EMBODIMENTS

The present invention will be more apparent from the accompanying drawings, which are provided by way of non-limiting example and in which.

Figure 3:
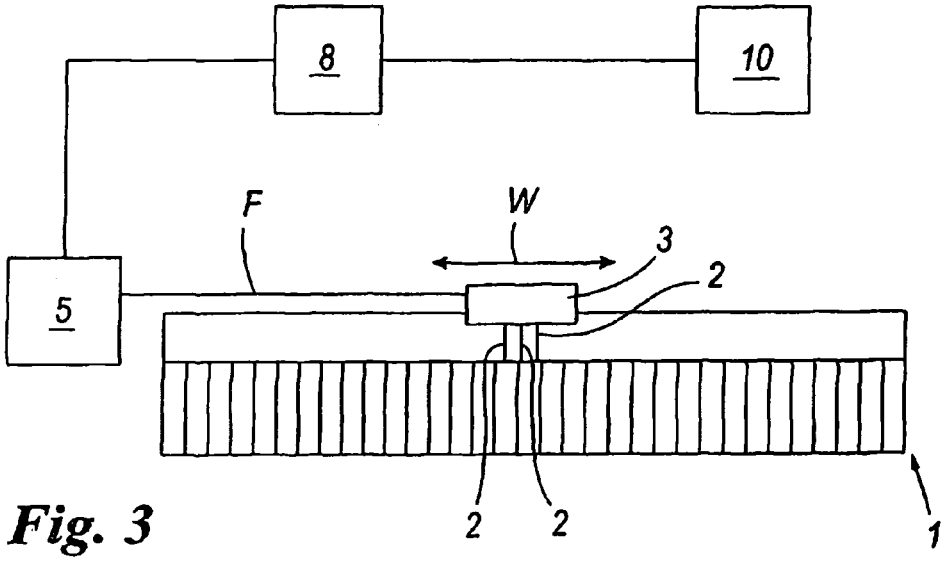
FIG. 3 shows a block diagram of a device according to the invention.

With reference to said figures, a rectilinear textile machine comprises, in known manner, a needle bed 1 presenting a plurality of needles 2; above this bed 1 a carriage 3, guided in known manner, moves with rectilinear translational movement to selectively raise the needles from the bed 1 by means of usual knitting cams (not shown). The carriage translates horizontally above the bed 1 while the needles 2 of this latter, in moving towards the carriage, come into cooperation with a yarn F fed to the carriage 3 by a yarn feed member 5 positioned on one side of the bed 1.

The feed member 5 is of the type adapted to feed the yarn F at constant tension and is provided with known means for measuring the fed yarn quantity. It is controlled in its operation by a control unit 8 which can form part of the usual textile machine control components or be a unit separate and independent from this latter. The unit 8 is connected to a display 10 which can also form part of said components or be totally separate from it.

The carriage 3 moves (arrow W of FIG. 3) along a working path or stroke comprising, in known manner, two phases: the first phase is that of movement away from the feed member 5, while the second is that of movement towards this latter. Because of these phases within which the carriage moves above the needle bed 1, the feed velocity of the yarn F under constant tension has different values, as can be seen from FIG. 1.

In this respect, while the carriage 3 moves away from the feed member, the feed velocity is:

$$\text{Feed_Velocity}=\text{Yarn_Velocity}+\text{Carriage_Velocity},$$

whereas while the carriage 3 moves towards the feed member 5, the feed velocity is:

$$\text{Feed_Velocity}=\text{Yarn_Velocity}-\text{Carriage_Velocity}.$$

Figure 1:
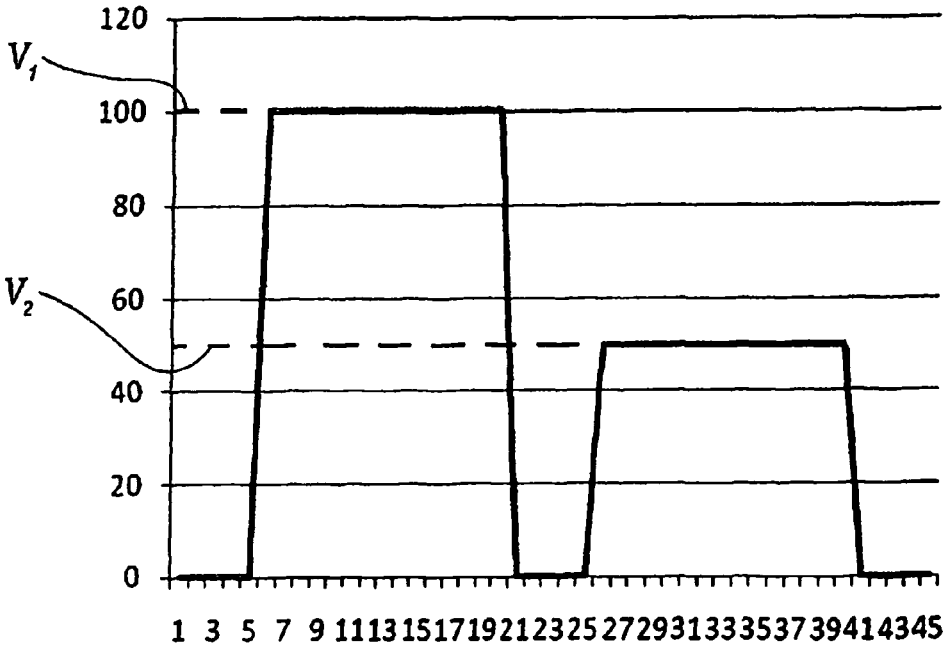
FIG. 1 shows a graph representing the yarn feed velocity during the two phases of the carriage travel stroke of a rectilinear machine above its needle bed.

These different velocities are indicated by $V_1$ and $V_2$ in the graph of FIG. 1.

By monitoring the feed velocity or any other quantity related thereto (for example by monitoring the feed member motor torque, its regulation or the actual measured AYL, etc.) automatic synchronization can be achieved between the AYL and the two movement phases of the carriage 3.

Figure 2:
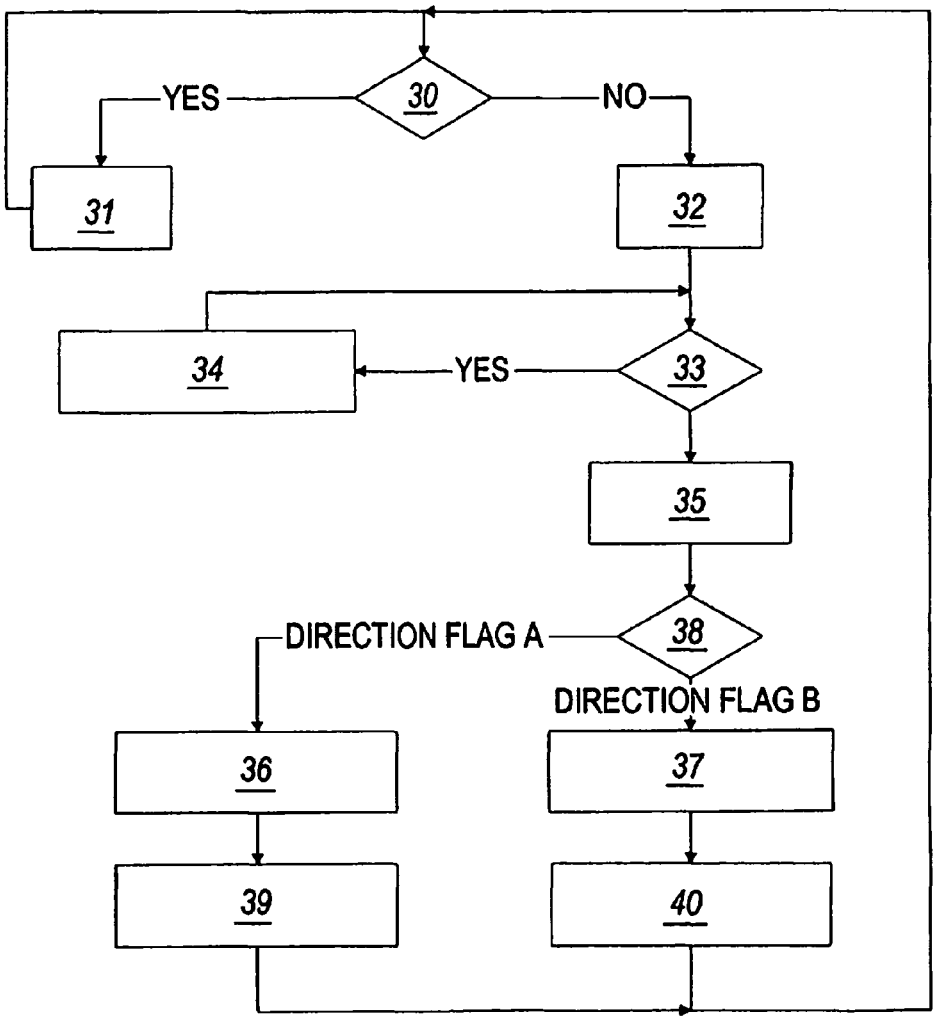
FIG. 2 is a block diagram of part of the method of the invention, and showing the operation of a device according to the invention.

The method of the invention will now be described with reference to FIG. 2. The device of the invention also operates in accordance with this figure.

In an initial step (block 30) the velocity of an AYL measurer is continuously analyzed, to verify whether this is equal to zero or less than a threshold value (carriage at rest) or other than zero or than the threshold value (carriage in movement). If the carriage is at rest (for example, velocity=0), the temporary counters used to measure the fed yarn length are zeroed or reset in the block 31.

This length value is for example measured by a usual roller cooperating with the yarn and provided with means to measure the AYL (such as Hall sensors, encoders, . . . ) and keyed onto a motor which enables its velocity to be regulated to maintain the tension constant. This roller acts as an AYL measurer.

If the measured feed velocity is greater than zero (or than the threshold value predefined for example by self-learning or set by an operator), the algorithm commences (block 32) counting within a temporary counter for the fed yarn quantity.

If the measured velocity continuously remains above the threshold value (this being examined in the block 33), the AYL and feed velocity measurement counters are updated (the velocity value could also be mediated to prevent motor velocity variations due to maintaining the tension constant from being able to invalidate the Start and Stop activation threshold of the software counters, in such a manner as to intercept with absolute certainty any exceeding of said threshold (block 34)).

When the velocity returns to zero or to the predefined threshold value or following a command given at a precise moment selected, for example, by self-learning or set by an operator, counting is halted (i.e. updating of counter in block 35), and the data relative to the measured velocity (the mean) and to the fed yarn quantity (or AYL) are memorized in an appropriate register (block 36 or block 37), based on the state of a flag (direction flag, block 38), which is then complemented at each memorization to have an alternation of values in the interior of the two registers.

Following the data memorization in block 36 or 37, data memorization is switched over in the subsequent carriage movement phase in blocks 39 and 40 (direction flag). In other words, in block 39 (or 40), data is memorized, to be determined as relative to the opposite movement phase to that just carried out.

By interrogating the device, for example via an interface connected to the unit 8 (for example via the display 10), the yarn quantity fed by the carriage during each of its movement phases above the needle bed 1 can be determined; it can also be determined in real time whether the carriage is in the phase of approaching or withdrawing from the member 5 by monitoring the value of the direction flag in the blocks 39 and 40.

Hence knowing the carriage direction with absolute certainty, a different working tension can be associated with each movement direction, such that the resultant tension on each needle is the same in both directions. In this respect, as the tension generated by the yarn on the needle is equal to the feed tension plus the tension added by cooperation of the yarn with the thread guide due to friction (friction tension which varies as a function of velocity), it is apparent that by maintaining the same tension both during the carriage withdrawal phase and during the carriage approach phase, the tension at the feeder exit is always the same but the tension on the needle varies because of the different frictions.

Considering the aforegoing, it is evidently hence possible to modify the feed tension on the basis of the carriage direction in order to maintain constant the resultant tension on the needle.

This modification can be carried out both in the case of self-synchronization and in the case in which the direction signal is withdrawn by direct interfacing with the machine (external synchronization), which synchronization can be of hardware or software type (for example via a serial line).

If the feed and measurement device is mounted laterally to the machine, association of the two registers with the movement direction is automatic. In this respect, the greater velocity is associated with that movement direction in which the yarn length (AYL) is measured during the carriage withdrawal from the feeder whereas, vice versa, the lesser velocity is associated with that movement direction in which the yarn length (AYL) is measured during the carriage approach to the feeder.

If the feed and measurement device is mounted centrally to the carriage, the device is still able to measure the yarn length (AYL) with absolute accuracy, but is not able to automatically discriminate the carriage direction. The operator must therefore associate the physical significance of the carriage movement direction (movement from let to right or from right to left) with the direction flag present in the device and complemented automatically at each carriage travel stroke.

To obtain the yarn quantity effectively knitted (AYL) from the two registers 36 and 37 relative to the yarn quantity fed in the two directions, account must be taken of the needle bed being worked (including any extra-stroke to the right and left of the thread guide at the exit of the working field).

Imagine for example, for calculation simplicity, a machine composed of 1000 needles (fineness 14) within which the working field is 700.

Assuming the feed and measurement device to be mounted on one side of the bed 1, the following formulas can be deduced:

a) During withdrawal of the carriage 3 from the feeder 5, the yarn quantity fed is equal to the yarn quantity used for effective production (AYL) plus that used for moving over the entire needle bed. i.e.:

Total_AYL=Knitted_Yarn_AYL+Working_Needle_Field_AYL

Where the individual terms indicate the following quantities:

Knitted_Trn_AYL Yarn quantity fed by the machine to produce the knitwork.

Working_Needle_Field_AYL Yarn quantity which has not been knitted but simply fed to enable the carriage to slide above the working needle bed 1.

b) During approach of the carriage 3 to the feeder 5, the fed yarn quantity is the previously stated AYL, the yarn used on the bed 1 not being considered, this having already been fed by the feeder 5 to enable the carriage 3 to reach that end of the bed 1 distant from that where the feeder 5 is present.

Total_AYL=Knitted_*Trn*_AYL−Working_Needle_Field_AYL

Where the individual terms indicate the following quantities:

Knitted_Trn_AYL Yarn quantity fed by the machine to produce the knitwork.

Working_Needle_Field_AYL Yarn quantity which has not been knitted but simply fed to enable the carriage to slide above the working needle bed 1.

From an analysis of the algebraic sums of the preceding points a) and b) it is apparent that the two AYL measurements differ by a quantity equal to Working_Needle_Field_AYL i.e. the yarn quantity used to enable the carriage 3 to move along the bed 1. As the needle bed length can be calculated (and with it the yarn length required to enable the carriage 3 to travel from one end to the other along this bed), the AYL for producing an article can be determined with absolute precision. In this respect, considering the AYL value measured by the feeder 5, to or from this value there can be added or subtracted the value relative to the aforesaid needle field or needle bed 1 (depending on the direction of movement of the carriage 3 above this latter), to hence obtain the yarn quantity or length fed for producing the article and consequently obtain an absolute knitting density.

This calculation is made by the unit 8 (which has memorized the value of the yarn quantity used to travel along the needle bed 1) which measures the value of the yarn fed by the feeder 5 and the data originating from the registers of the aforesaid blocks 36, 37, 39 and 40.

This calculation is carried out with extreme precision and enables the correct AYL to be obtained during each movement direction of the carriage 3. An AYL value can hence be associated with each of these latter and its constancy be verified for the entire duration of the article production. This value can also be used in other rectilinear machines to achieve a production constancy within one and the same manufacturing installation provided with several machines.

The absolute consumption value obtained according to the invention can be used for precise and rapid calibration of the textile machine. In time terms this solution enables the textile machine to be regulated in just a few minutes in contrast to the currently used traditional solution which requires some hours for regulation without even guaranteeing effective regulation quality and precision. This is because the same device is used both for calibration and in the production stage; the device is therefore able to monitor and hence guarantee a constant quantity even following the calibration stage, and if necessary to halt the machine in case of error.

Being completely automatic, the present device can be used on any type or model of rectilinear machine, whether electronic (including the very latest generation) or completely mechanical.

The invention claimed is:

1. A method for automatically evaluating the yarn length absorbed by a rectilinear machine to produce an article, the machine comprising a needle bed and a carriage; comprising the steps of:

moving, above the needle bed, said carriage carrying at least one thread guide, said carriage moving between two ends of a working path in accordance with a first and a second operative phase which take place along opposing movement directions, during this movement said carriage selectively raising and lowering, from and into said bed, needles arranged to cooperate with said yarn to form the article, unwinding said yarn from a feeder, this feeder comprising means for measuring the yarn quantity fed towards said needle bed, yarn feed taking place at constant tension, the feeder measuring the yarn feed velocity during each operative phase, and if this feed velocity is greater than a threshold value the yarn quantity fed in the respective operative phase is measured until said feed velocity attains a value less than the threshold value, the values of these quantities measured during each operative phase being algebraically added to a value relative to the yarn quantity fed to the carriage during each phase to enable the carriage to pass from one end to the other of the working path and vice versa, from this algebraic sum there being determined the yarn quantity effectively fed to the needles for article production during each operative phase.

2. A method as claimed in claim 1, wherein a precise direction of movement of the carriage above the needle bed, or a specific carriage operative phase, is associated with each algebraic sum, this enabling determination of the yarn quantity effectively fed to the needles for article production during each of said phases, said determination taking place by considering the sum of the fed yarn quantity value determined during withdrawal of the carriage from the feeder and the yarn quantity value necessary to enable the carriage to move along the entire needle bed from the position close to the feeder to the opposite end position at the end-of-stroke, and by considering the subtraction between the fed yarn value determined during approach of the carriage to the feeder and said yarn quantity value necessary to enable the carriage to move along the entire needle bed.

3. A method as claimed in claim 2, wherein each operative phase is manually associated with a fed yarn length value.

4. A method as claimed in claim 2 wherein each operative phase is automatically associated with a fed yarn length value.

5. A method as claimed in claim 1, wherein the yarn is fed, during each operative phase, with different constant tensions, the constant yarn tension during movement in the first operative phase being different from the constant yarn feed tension during movement in the second operative phase.

6. A method as claimed in claim 1, wherein the value relative to the yarn fed to the carriage to enable this carriage to pass from one end to the other of the needle bed during each operative phase is a known value corresponding to the length of said needle bed.

7. A method as claimed in claim 1, comprising displaying the calculated value of the yarn quantity fed to the needle bed to produce an article.

8. A method as claimed in claim 1, comprising using the calculated value of the yarn quantity fed to the needle bed for a rectilinear machine to control the production of various rectilinear machines, said control being obtained by controlling the operation of the yarn feeder of these various rectilinear machines.

9. A device for automatically evaluating the yarn length absorbed by a rectilinear machine to produce an article, the machine comprising a needle bed and a carriage, wherein above the needle bed the carriage is moveable carrying at least one thread guide, said carriage moveable between two ends of a working path in accordance with a first and a second operative phase which take place along opposing movement directions, during this movement said carriage selectively raising and lowering, from and into said bed, needles arranged to cooperate with said yarn to form the article, a feeder for unwinding said yarn from the feeder, this feeder comprising means for measuring the yarn quantity fed towards said needle bed, yarn feed taking place at constant tension, means for measuring the velocity of yarn feed by the feeder during each operative phase, means for measuring the fed yarn quantity arranged to operate while the measured velocity exceeds a threshold value, means for controlling and evaluating the yarn quantity fed during each operative phase and arranged to calculate an algebraic sum by algebraically adding the data of these measured quantities to a value relative to the yarn quantity fed to the carriage during each phase to enable said carriage to pass from one end to the other of the working path and vice versa, from this algebraic sum said controlling and evaluating means determining the yarn quantity effectively fed to the needles for article production during each operative phase, and if necessary intervening to maintain the yarn tension at a constant value during each operative phase.

10. A device as claimed in claim 9, wherein the constant yarn feed tension during movement in accordance with a first operative phase is different from the constant yarn feed tension during movement in the second operative phase.

11. A device as claimed in claim 10, comprising means for associating a precise direction of movement of the carriage above the needle bed, or a specific carriage operative phase, with the measurement of the fed yarn quantity, this enabling determination of the yarn quantity effectively fed to the needles for article production during each of said operative phases, said means being activated manually or automatically.

12. A device as claimed in claim 9, wherein said feed velocity measurement means operate on electric actuator/motor feed members for the yarn, said feed velocity measurement means determining a characteristic quantity of said feed, such as the torque of an electric feed motor, and on the basis thereof obtaining the yarn feed velocity, the measurement means for the fed yarn quantity being a roller-operated yarn quantity measurer associated with the feeder, the controlling and evaluating means being a feeder operation control unit, said feeder operation control unit forming part of a control circuit for the rectilinear machine or being a unit totally separate from the machine.

* * * * *